US007918074B2

(12) United States Patent
Vaughn et al.

(10) Patent No.: US 7,918,074 B2
(45) Date of Patent: Apr. 5, 2011

(54) TREELESS EXERCISE SADDLE FOR RACEHORSES

(76) Inventors: Francis Vaughn, Hummelstown, PA (US); Peter DeCosemo, Barlborough (GB)

( * ) Notice: Subject to any disclaimer, the term of this patent is extended or adjusted under 35 U.S.C. 154(b) by 0 days.

(21) Appl. No.: 11/633,764

(22) Filed: Dec. 4, 2006

(65) Prior Publication Data

US 2007/0186519 A1 Aug. 16, 2007

Related U.S. Application Data

(60) Provisional application No. 60/742,039, filed on Dec. 2, 2005.

(51) Int. Cl.
*B68C 1/02* (2006.01)

(52) U.S. Cl. ..... 54/44.5; 54/44.1

(58) Field of Classification Search ..... 54/23, 44.1, 54/44.5, 44.7, 46.1, 66
See application file for complete search history.

(56) References Cited

U.S. PATENT DOCUMENTS 184,975 A * 12/1876 McCormick ..... 54/66
443,087 A * 12/1890 Cusson ..... 54/44.7
862,572 A * 8/1907 Maussner ..... 54/46.1
4,905,458 A * 3/1990 Johnston et al. ..... 54/23
6,370,850 B1 * 4/2002 Zilka ..... 54/66
6,434,915 B1 8/2002 DeCosemo
6,688,087 B2 2/2004 DeCosemo
2006/0080946 A1 4/2006 DeCosemo

FOREIGN PATENT DOCUMENTS

WO WO-2004/016320 A2 2/2004

* cited by examiner

*Primary Examiner* — Rob Swiatek
(74) *Attorney, Agent, or Firm* — Dilworth Paxson LLP

(57) ABSTRACT

A treeless exercise saddle for training racehorses is provided. The saddle comprises a top surface having a substantially contiguous seat portion adjacent to opposing side panels, and a substantially flat pommel area; a bottom surface opposed to the top surface of the saddle and having a pair of opposing conformable panels affixed to the bottom surface of the saddle. The conformable panels have substantially rectangular cross sections. Optionally, leg flaps may be affixed to the seat portion and the pommel area. The facing surfaces of the conformable panels, together with the bottom or other surface of the saddle, form a gullet area. The gullet area has a cross section wherein the facing surfaces are substantially straight, and wherein the bottom or other surface of the gullet area is substantially straight and substantially perpendicular to the straight facing surfaces, such that the racehorse's spine may protrude into the gullet area when the saddle is mounted on the racehorse.

14 Claims, 7 Drawing Sheets

TREELESS EXERCISE SADDLE FOR RACEHORSES

CROSS REFERENCE TO RELATED APPLICATION

This application claims the priority of U.S. Provisional Patent Application Ser. No. 60/742,039, filed Dec. 2, 2005, entitled "Treeless Exercise Saddle for Racehorses", under 35 U.S.C. §119 (e), the entire contents of which are incorporated herein by reference.

FIELD OF INVENTION

This invention is directed to saddles for horses. More particularly, this invention is directed to treeless saddles for horses. Still more particularly, this invention is directed to treeless saddles for the training of horses, and particularly thoroughbred horses.

BACKGROUND OF INVENTION

The instant invention stems from uncovering a longstanding problem within the thoroughbred racing industry. Each year a little over thirty thousand horses are born and registered with the Thoroughbred Racing Association. Of those horses, less than ten percent actually make it to a racetrack to run in a horse race for a purse. Many of these hoses never race because of injuries sustained during the process of training the horse to race.

In racing, a foal's officially registered birthday is January 1$^{st}$ regardless of the date during the year which the foal is actually born. A horse which is less than a year old is called a weanling. A yearling is a horse one year old, dating from January 1 of the year after foaling. Typically, horses are trained for riding as yearlings and usually begin training for racing as two year olds. Horses typically begin to race competitively late in their second year. Many of these horses are seriously injured within these first few years, are unable to race again, and have to be retired or sold.

A typical horse doesn't finish growing until it is about five years old. In the racing industry a horse's third year is critical. A horse may be entered in the Triple Crown races (i.e. The Kentucky Derby, The Preakness Stakes, and The Belmont Stakes) as a three year old colt, gelding (male horses), or filly. The Kentucky Derby is raced on the first Saturday in May and the Preakness is two weeks later. The Belmont Stakes is three weeks after the Preakness. No horse has won the Triple Crown since 1978. Recently a few horses have come close but have become injured in their quest to win all three Triple Crown races in this short span of time. A horse that completes the Triple Crown would earn a $5 million bonus, as well as a future as a stud for which breeding fees would bring close to 100 million dollars to the owners. Thus there is great incentive to train horses for racing in their third year and beyond.

Inasmuch as horses are not fully grown until around the age of five, there is a great deal of risk associated with training and racing two and three year old horses. Specifically, a horse's bones and muscles are still growing and putting stress by training and running creates what the industry calls "breakdowns" which may end a horse's racing career. Thus, many horses are injured during the training process and never achieve their full potential in the racing industry.

Industry research has uncovered that almost seventy-five percent (75%) of injuries to horses in the racing industry occur to the left front leg. Since uncovering this data, we have been able to determine that the pressure imposed on the horse by the tree in the saddle impedes and restricts the horse's movement. See the attached photographs for examples of such trees and saddles employing such trees. This pressure is particularly acute on the horse's left shoulder and back. Such pressure typically impedes the horse from fully extending its stride. As a result, the horse makes shorter and slower strides and eventually may be reluctant, may refuse, or may be rendered unable to run.

In addition, in the United States, horses are typically trained, ridden and raced in a counter-clockwise direction which causes the horse to place most of its weight on the left side to keep its balance. When a rider sits atop a horse and the horse is ridden in a counter clockwise direction, the rider places most of his or her weight on the left side of the horse. With saddles utilizing trees, this weight shifting puts pressure on the tree and hence the shoulders and back on the left side of the horse. The tree digs into the horses shoulder and back which creates discomfort and sometimes shortens the length of stride thereby causing the movements to become slower.

Training riders typically weigh between 125-150 lbs but sometimes weigh up to 175 lbs or more. This weight combined with the heavier tree saddle creates pressure and stress on the horses back and shoulders. Additionally, horses running in a race often travel at top speeds of about 40 miles per hour. Traveling at such speeds necessitates the need for the rider to feel, and actually be, safe on the saddle.

While the rider's weight cannot be changed, the rider's weight may be redistributed on the horse's back and shoulders. Consequently displacing a rider's weight on the horses back and shoulders would help to alleviate the problems caused by the tree component of saddles.

Therefore, the need exists for a treeless saddle or similar device which alleviates the problems of existing saddles, and particularly, thoroughbred training saddles.

SUMMARY OF THE INVENTION

The invention disclosed herein is directed to a treeless exercise saddle for horses. The saddle of this invention is intended to be used primarily in the horse racing industry, however any appropriate use suggested by the disclosure herein may be made of the saddle of this invention. One feature of the saddle of this invention removes direct pressure from a horse's shoulder, scapula, and back by eliminating as an element of the saddle the rigid metal or wooden "tree" which is present in all known prior art racing saddles. Removing the tree from, and making certain improvements to, the saddle disclosed herein substantially eliminates pressure and stress placed on the horse by the tree and permits the horse to extend its stride as a result of the reduction of such pressure and stress. In addition, the treeless saddle of this invention is also lighter than those saddles having trees thereby allowing the horse to work with less weight on its shoulders and back. The design of the saddle of this invention also distributes the weight of the jockey over a larger area of the horse's shoulders further allowing the horse to make its stride more freely.

Essentially, the saddle of this invention conforms to the horse's body as, analogously, as a glove fits on a hand. Because certain components of the saddle of this invention are flexible and/or pliable and, in at least one embodiment, the saddle is made from foam and soft leather, the saddle conforms to almost every horse regardless of its physical makeup. In this regard, the saddle flexes and conforms to each of the horse's movements allowing the horse to move freely without the pain or soreness typically associated with a tree saddle.

Thus, in one embodiment, the invention disclosed herein is directed to a treeless saddle having upper and a lower surfaces comprising: a seat portion; a pommel area portion adjacent to said seat portion; side panels adjacent to said seat and/or pommel area portions; conformable panels integrated into said lower surface of said saddle and forming a gullet area substantially between said conformable panels.

BRIEF DESCRIPTION OF THE DRAWINGS

Understanding of the present invention will be facilitated by consideration of the following detailed description of the embodiments of the present invention taken in conjunction with the accompanying drawings, in which like numerals refer to like parts, and wherein.

DETAILED DESCRIPTION OF THE EMBODIMENTS

It is to be understood that the figures and descriptions of the present invention have been simplified to illustrate elements that are relevant for a clear understanding of the present invention, while eliminating, for the purposes of clarity, many other elements which may be found in the present invention. Those of ordinary skill in the pertinent art will recognize that other elements are desirable and/or required in order to implement the present invention. However, because such elements are well known in the art, and because such elements do not facilitate a better understanding of the present invention, a discussion of such elements is not provided herein.

Figure 1:
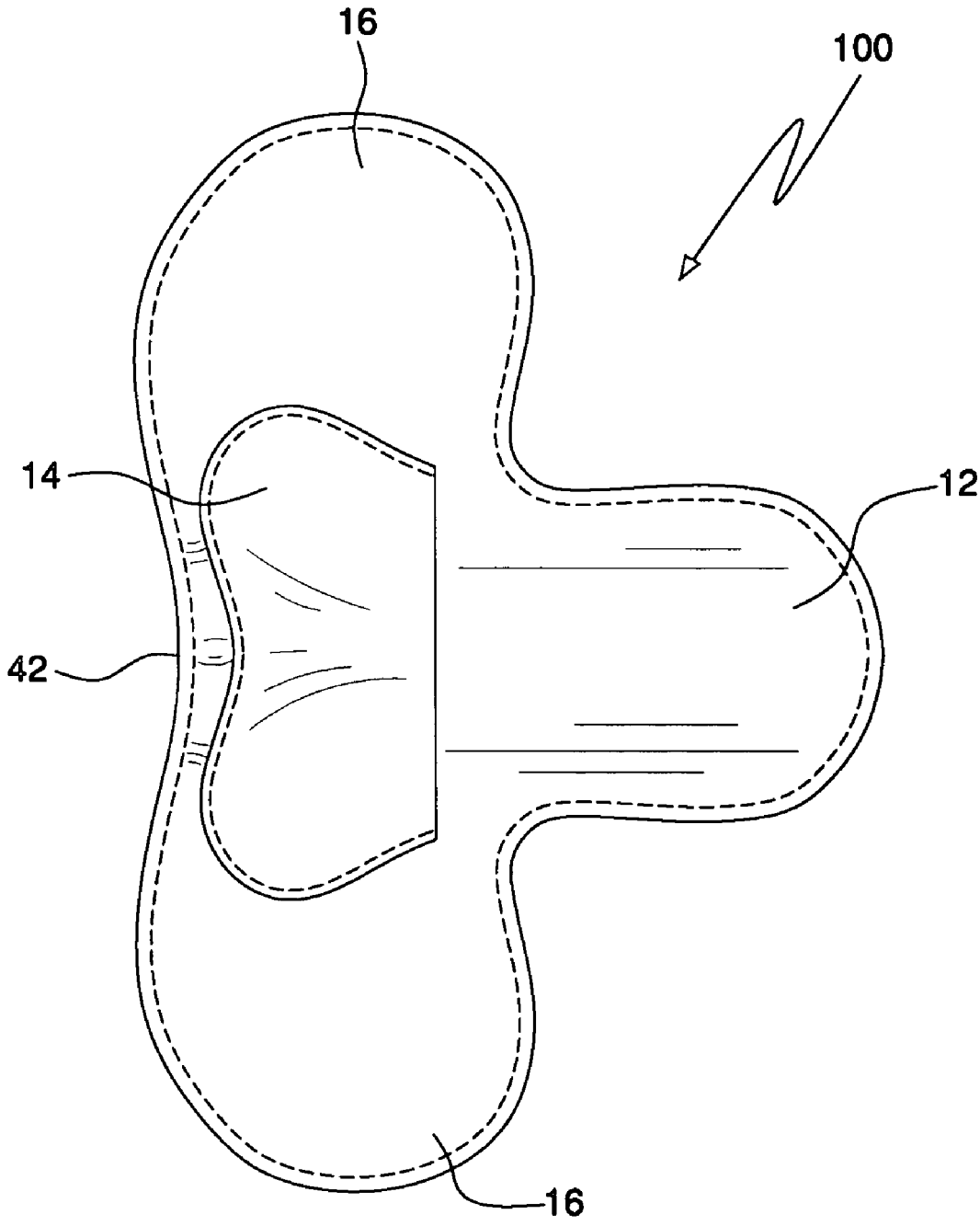
FIG. 1 is a plan view of the top surface of a pattern of a treeless racing exercise saddle of this invention prior to the assembly of the saddle of this invention.

Referring now to FIG. 1, there is shown an embodiment of the top surface of pattern 100 of the treeless exercise saddle prior to the assembly of the saddle 10 of this invention. As shown, the components of pattern 100 are laying flat. Pattern 100 is shown comprising a seat portion 12, side panels 16, and, optionally, leg flaps 14 which are intended to cover, by way of nonlimiting example, stirrup hangers (such at those shown in FIG. 7).

Figure 2:
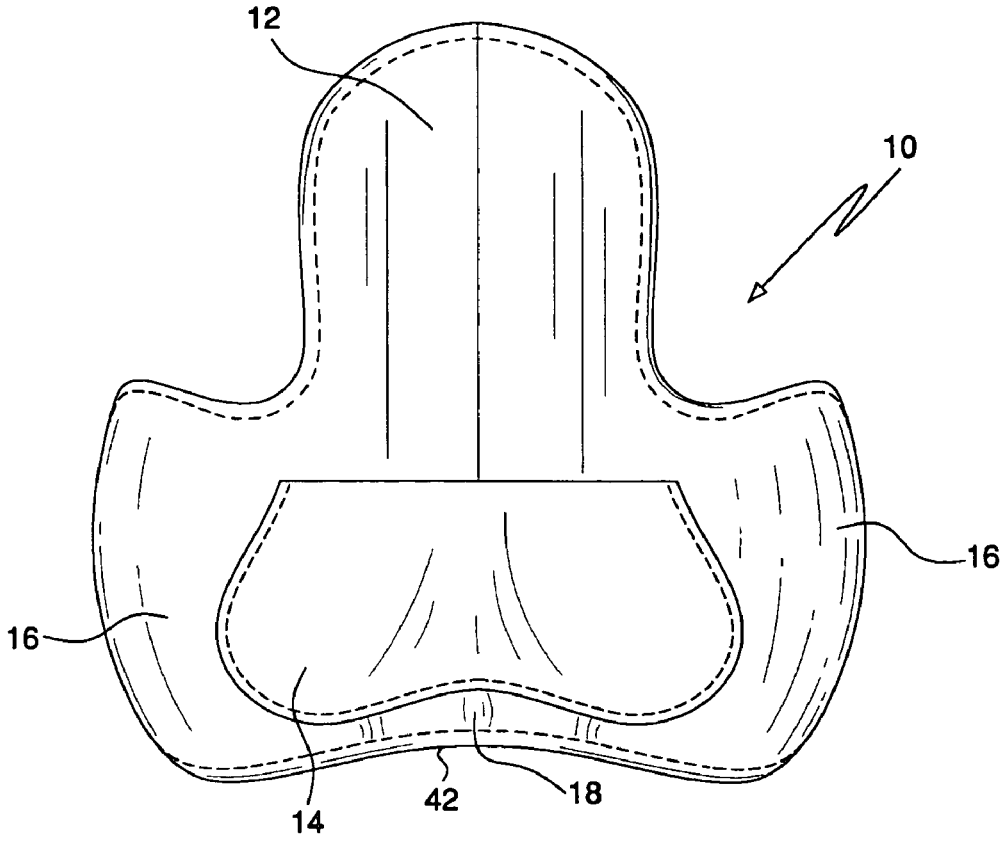
FIG. 2 is a plan view of the top surface of an assembled treeless racing exercise saddle.

Turning now to FIG. 2, an embodiment of the treeless racing exercise saddle of this invention is indicated with the numeral 10 as shown. Saddle 10 comprises a seat portion 12, side panels 16 and, optionally, leg flaps 14 that cover, for example, stirrup hangers (such as those shown in FIG. 7). Most of the surfaces which comprise saddle 10 are made from leather or other suitable materials.

Figure 3:
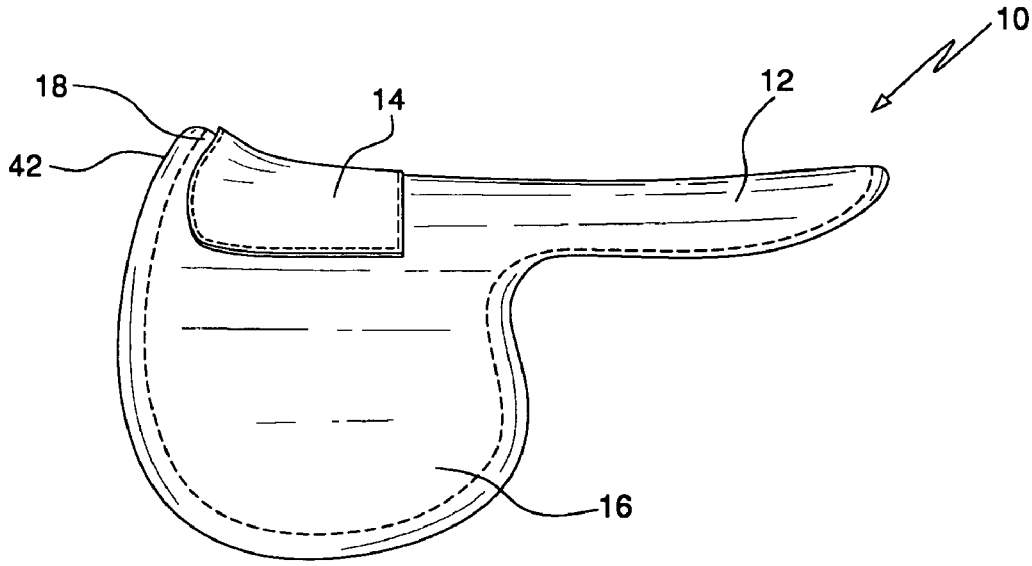
FIG. 3 is a side elevation of the saddle of FIG. 2.

FIG. 3 depicts a side view of treeless racing exercise saddle 10, wherein the rider sits facing front edge 42 and which comprises seat portion 12, side panel 16, and a built up pommel area 18. Pommel area 18 provides a forward surface of saddle 10 with which the rider may come in contact with during riding, as well as a surface which the rider may grasp.

Figure 4:
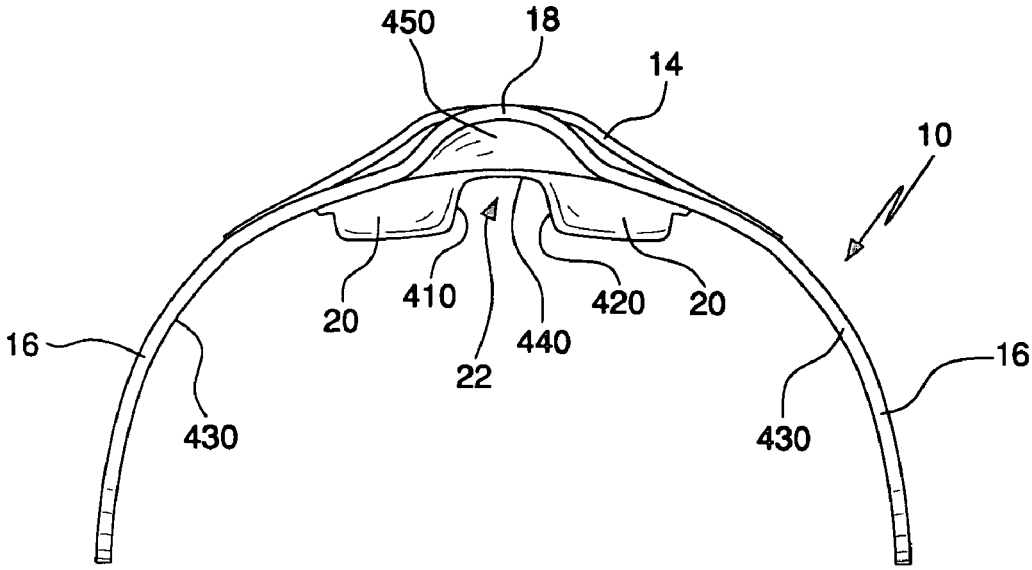
FIG. 4 is a front elevation of the saddle of FIG. 2.

FIG. 4 depicts a front view of saddle 10 comprising pommel area 18, two conformable panels 20, and gullet area 22 which lies between conformable panels 20. Conformable panels 20 and gullet area 22 are each located on the underside of saddle 10.

Pommel area 18, and conformable panels 20 may be built up with foam or any other suitable material which provides comfort to the rider and/or horse. As shown in FIGS. 2, 3, 4 and 12, pommel area 18 may also comprise a raised region which forms an opening 450 into which a rider may easily, quickly, safely and comfortably insert his or her hand for grip and/or stability. Alternatively, pommel area 18 may comprise a substantially flatter profile than shown in FIGS. 2, 3, 4 and 12 and which conforms more closely to the overall convex shape of the top surface of saddle 10 when mounted on a racehorse. This alternative embodiment does not provide for opening 450 into which a rider may easily, quickly, safely, and/or comfortably insert his or her hand, if at all. In yet another embodiment, pommel area 18 may be built up with foam or similar materials, however, substantially no opening 450 is provided.

Conformable panels 20 and gullet area 22 may also comprise any shape, so long as the resulting shape conforms to the portion of the horse on which saddle 10 contacts. In one embodiment, conformable panels 20 have a substantially rectangular cross section, as shown in FIG. 4. Shown also in FIG. 4 is gullet area 22 which area is defined by facing side portions 410 and 420 of said conformable panels 20 and the bottom surface 430 of said saddle 10 or other surface generally denoted as surface 440. In this embodiment, surfaces 430 or 440 (depending on the embodiment) are substantially perpendicular to side portions 410 and 420.

Panels 20 may be filled with or otherwise comprise a substance which permits panels 20 to conform to the portions of the horse with which panels 20, and possibly the surfaces which form gullet area 22, contact the horse when saddle 10 is mounted on the horse. This conforming feature permits saddle 10 to sit substantially securely on the horse without injuring or otherwise causing discomfort to the horse. Accordingly, panels 20 may be constructed and/or arranged in any manner which achieves the result of permitting saddle 10 to sit substantially securely on the horse without injuring or otherwise causing discomfort to the horse.

When saddle 10 is mounted to the horse, panels 20 should be in contact with the horse straddling the spine of the horse while gullet 22 provides an area into which the spine may protrude. When a rider sits on saddle 10, panels 20 are compressed around the spine and at least partially conform to the shape of the horse in those areas which panels 20 contact the horse. When the horse is in motion and turns to the left, left panel 20 is further compressed and at least partially conforms to the horse due to the weight of the rider and centrifugal force. A similar effect may be achieved with compression of right panel 20 when the horse is turned to the right. The compression of panels 20, together with the saddle at least partially conforming to the spine of the horse will tend to impede the rotation of saddle 10 around the horse. Thus, saddle 10 does not injure or otherwise cause significant discomfort to the horse. Moreover, the rider is less likely to be thrown from saddle 10.

In addition, conformable panels 20 may be of differing sizes and/or shapes based upon the design and performance characteristics desired for saddle 10. For example, left panel 20 may be built up with additional compressible material causing left panel 20 to protrude from the underside of saddle 10 in an uncompressed state more than right panel 20. Building up left panel 20 in this fashion should enable saddle 10 to accommodate greater centrifugal forces in a left hand turning situation, and/or a rider of heavier weight. Other shapes and sizes of panels 20 and gullet area 22 may also be employed to achieve additional performance characteristics or results.

In yet another embodiment of this invention, side portions 410 and 420 may be other than substantially perpendicular to surfaces 430 or 440 in order to conform panels 20 more closely to the shape of the racehorse's back and spine. In this embodiment, slippage of saddle 10 on the racehorse may be reduced or eliminated as compared to the embodiment shown in FIGS. 2, 3, 4 and 12. By way of a nonlimiting example, side portions 410 and 420 may be formed at approximately a 45° angles from perpendicular causing the width of gullet area 22 to narrow as one moves closer to surfaces 430 or 440. Alternatively, sides 410 and 420 may be formed at any angle which may further reduce or eliminate slippage of saddle 10, and/or cause saddle 10 to conform to the racehorse's back and spine.

In addition, non-slip or skid materials (such as, by way of nonlimiting example, a non-slip shammy pad) may be employed on any surface of saddle 10 which comes in contact with the racehorse in order to reduce or eliminate slippage of saddle 10.

Figure 5:
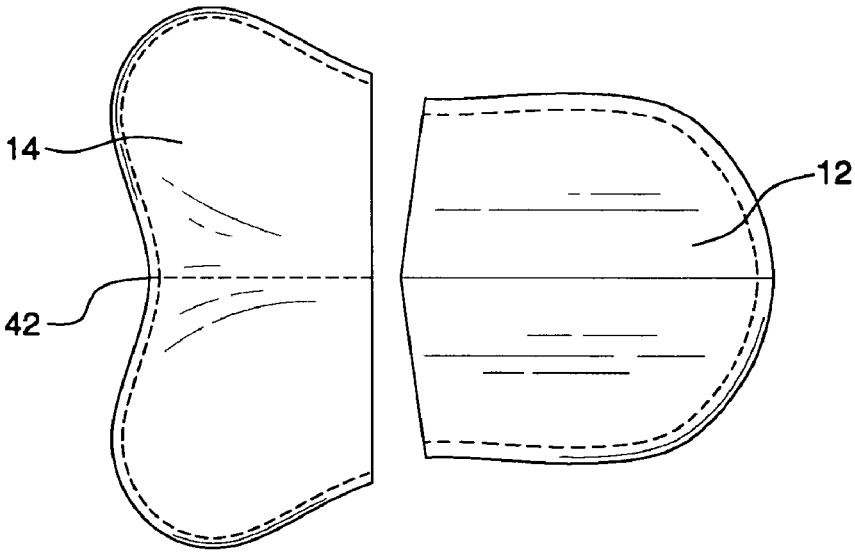
FIG. 5 is a plan view of the top surface of component portions which may form at least a portion of the saddle of FIG. 2.

Turning now to other possible features of the invention disclosed herein, FIG. 5 depicts a top view of optional leg flaps 14. Leg flaps 14 may be employed to cover stirrup hangers 38 (shown in FIG. 6 without leg flaps 14) and, possibly portions of seat portion 12, therein providing increased comfort and safety for the rider.

Figure 6:
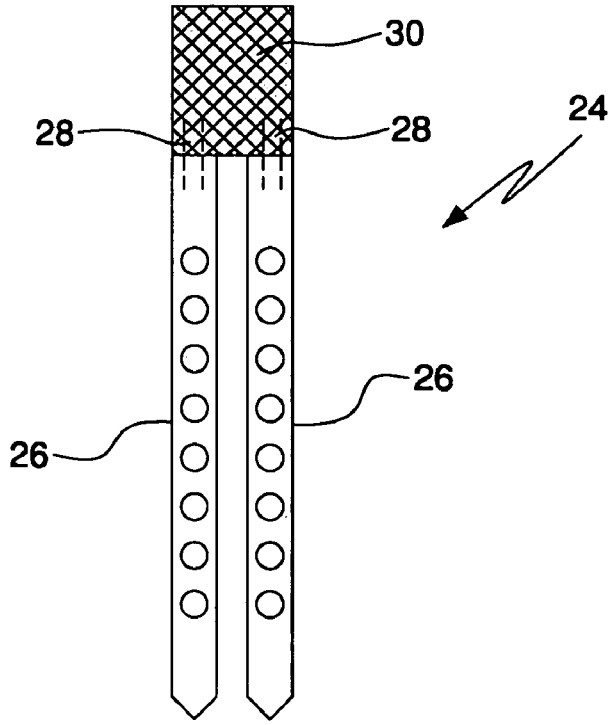
FIG. 6 is a side elevation of a billet strap which may be used with the saddle of FIG. 2.

FIG. 6 shows side view of girth attachment strap 24 which may also be referred to herein as a billet assembly or billet straps. Billet straps 26 may be constructed by stitching portions 28 to a length of webbing 30. Webbing 30 may comprise nylon webbing similar to that used for automobile safety seat belts or other suitable material. Alternatively, girth attachment strap 24 may be made entirely of any suitable leather. Folding of webbing 30 over upon itself approximately doubles the strength of billet assembly 24 so that saddle 10 may be securely fastened to the horse. In one embodiment, webbing piece 30 has a width of approximately two inches (2"), although other suitable widths may be employed. Use of two or more webbing pieces 30 further insures the safety of the rider in that the saddle will tend to remain secured to the horse even if one webbing piece 30 breaks or is otherwise damaged.

Figure 7:
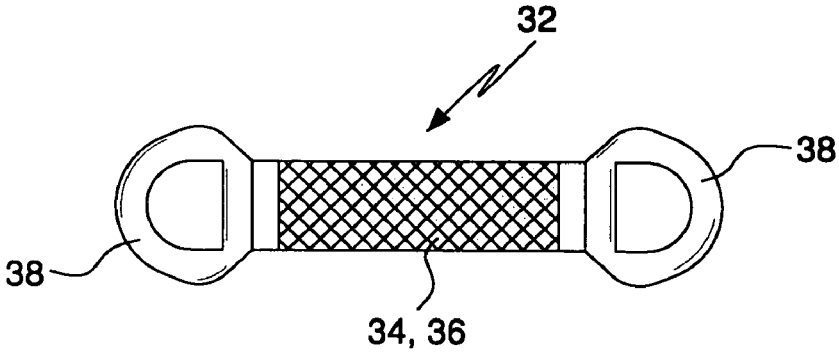
FIG. 7 is a plan view of a stirrup hanger which may be used with the saddle of FIG. 2.

FIG. 7 shows a top view of stirrup hanger 32 (also referred to as stirrup hangers 32). Stirrup hanger 32 may be made from webbing 34 wrapped by a leather (or other suitable material) strap 36, wherein webbing 34 and strap 36 may be attached together by stitching. Webbing 34 may comprise, by way of nonlimiting example, materials used in the manufacture of automobile or aircraft safety belts. Alternatively, strap 36 may be made entirely from a suitable leather. Both webbing 34 and strap 36 may have a width of approximately one and one quarter inches (1¼"). Strap 36 and webbing 34 connect two stirrup hanger bars 38.

Stirrup hanger bars 38 typically comprise a pre-cast, durable and strong material such as metal, although other constructions may be employed. Each of bars 38 measures approximately one and three quarter inches (1¾") by one and one half inches (1½"). Stirrup hanger 32 typically has a length of approximately six inches (6"). Of course, bars 38 and stirrup hanger 32 may be of any suitable dimensions. Alternatively, hanger bars 38 may take the form of a "quick release" type of stirrup hanger bar. However, in certain applications, a "quick release" construction may not be as safe as a solid pre-cast metal stirrup hanger bar.

Figure 8:
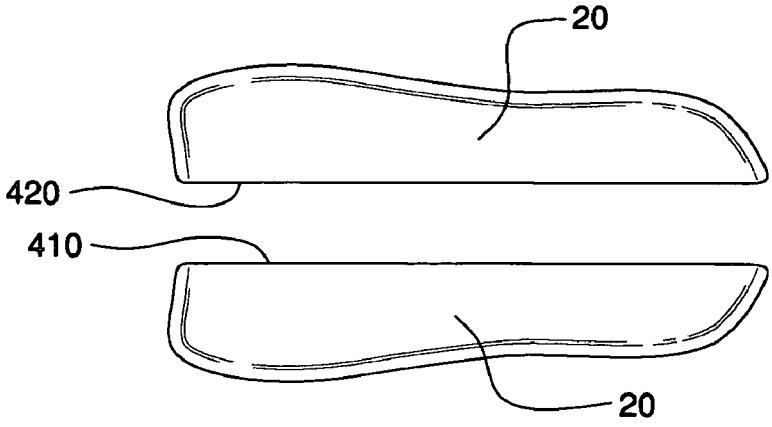
FIG. 8 is a plan view of sculpted conformable panels which may be integrated into the saddle of FIG. 2.

FIG. 8 depicts a plan view of right and left conforming panels 20 prior to affixation to the bottom surface of saddle 10. FIG. 8 depicts conforming panels 20, oriented as panels 20 would appear if viewing panels 20 after mounting to bottom surface 430 of saddle 10. In one embodiment, panels 20 may comprise foam padding wrapped or covered in a soft leather. Shown between conforming panels 20 is gullet area 22. Typically, gullet area 22 is provided as a space between conforming panels 20 in order to allow conforming panels 20, (as well as all or a portion of surfaces 410, 420 and/or 440) to rest substantially on the horse's back and on either side of the horse's spine.

Figure 9:
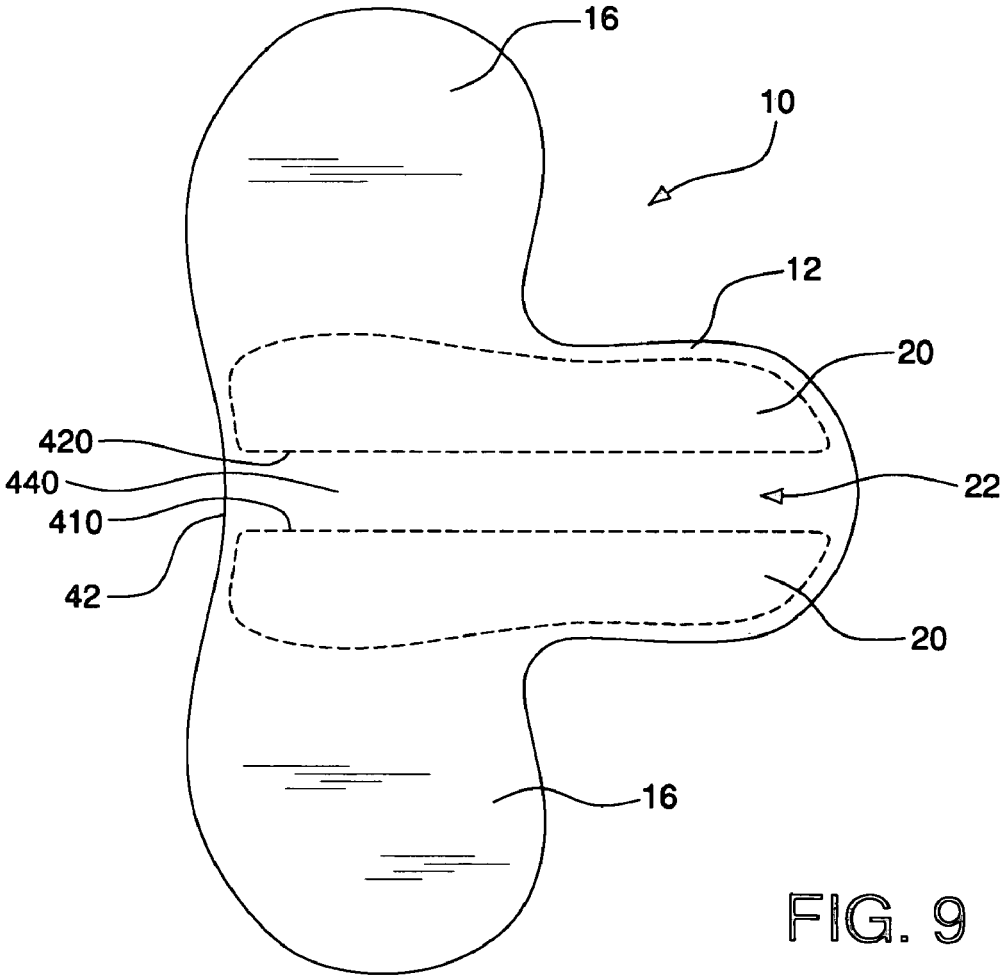
FIG. 9 is a plan view of the bottom surface of the saddle of FIG. 2 showing the relative positioning of the conformable panels of FIG. 8 in phantom.

FIG. 9 depicts a plan view of the bottom surface of one embodiment of saddle 10 having conforming panels 20 (shown in phantom) integrated into the bottom surface of treeless racing exercise saddle 10. Gullet area 22 is formed on or as part of the bottom surface of saddle 10, as a result of the shape of conforming panels 20.

Figure 10:
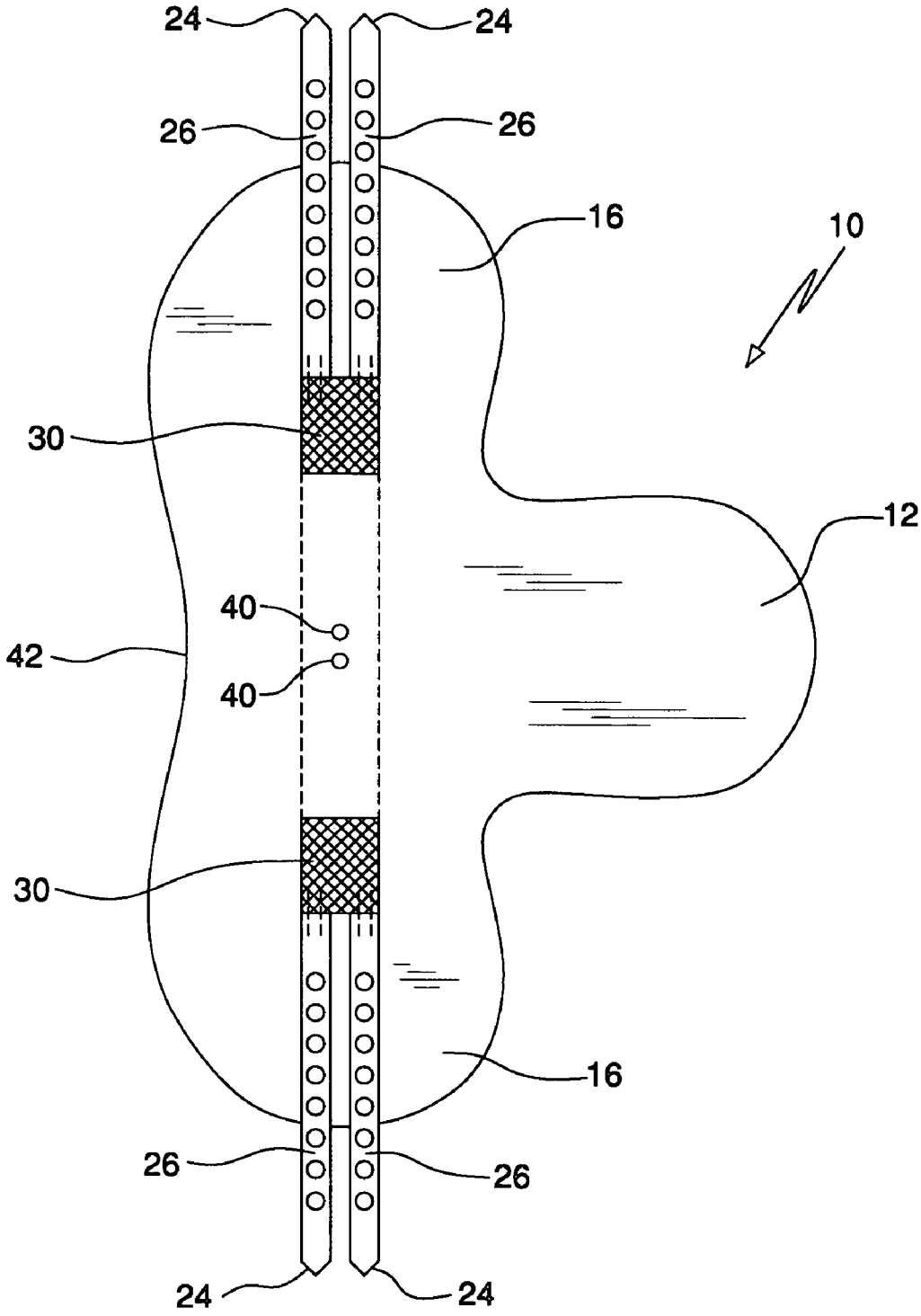
FIG. 10 is a plan view of the billet straps of FIG. 6 attached to the bottom surface of the saddle of FIG. 2.

FIG. 10 shows a plan view of the bottom surface of one embodiment of saddle 10 having girth attachment straps 24 attached to the bottom surface of treeless racing exercise saddle 10. One or more rivets 40 (typically one inch (1") polished copper rivets) are riveted upwardly from the underside of the body of saddle 10 through to the topside of the body of saddle 10 and are used to fasten girth attachment straps 24 to saddle 10. In one embodiment, the front edge of webbing piece 30 typically is positioned approximately two inches (2") from the front edge 42 of saddle 10. Alternatively, the entire girth attachment strap 24 assembly may be constructed substantially or completely from leather.

Figure 11:
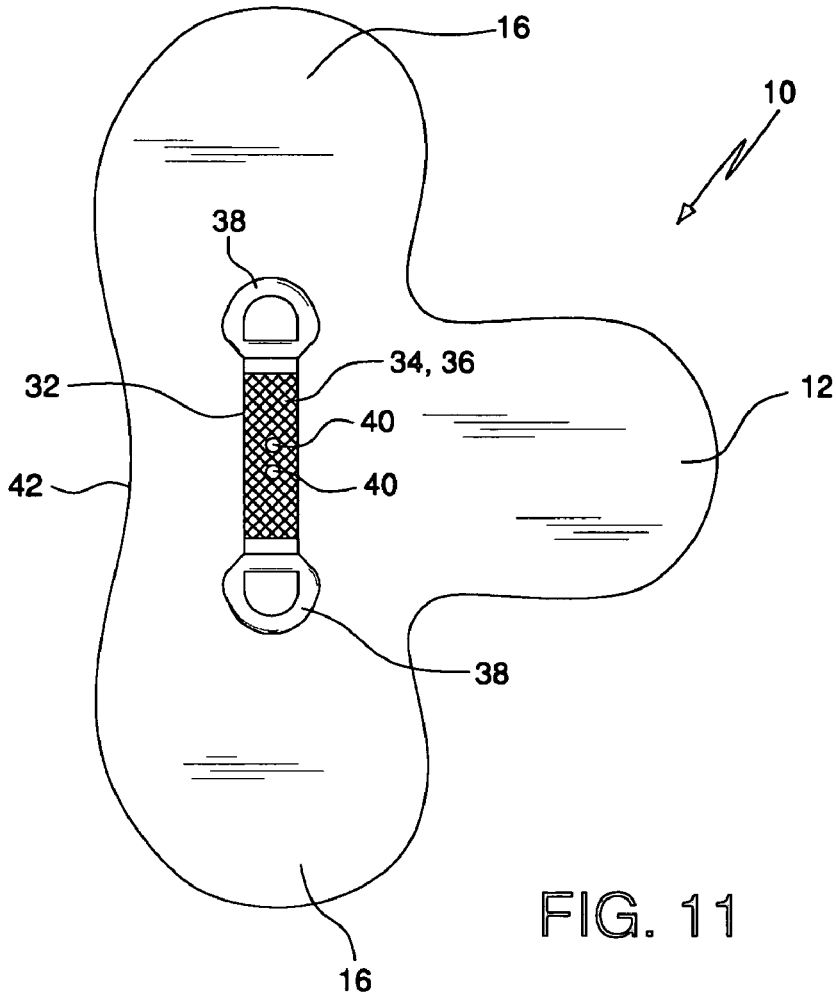
FIG. 11 is a plan view of the stirrup hangers of FIG. 7 attached to the top surface of the saddle of FIG. 2.

FIG. 11 depicts a plan view of the top surface of one embodiment of saddle lo having stirrup hanger 32 attached to saddle 10 by rivets 40. Rivets 40 are punched through the surface of the underside of saddle 10, and saddle 10 body portions to secure stirrup hanger 32 to saddle 10. In one embodiment, the forward facing edge of webbing piece 34 and leather strap 36 typically is positioned approximately two inches (2") from front edge 42 of saddle 10.

Figure 12:
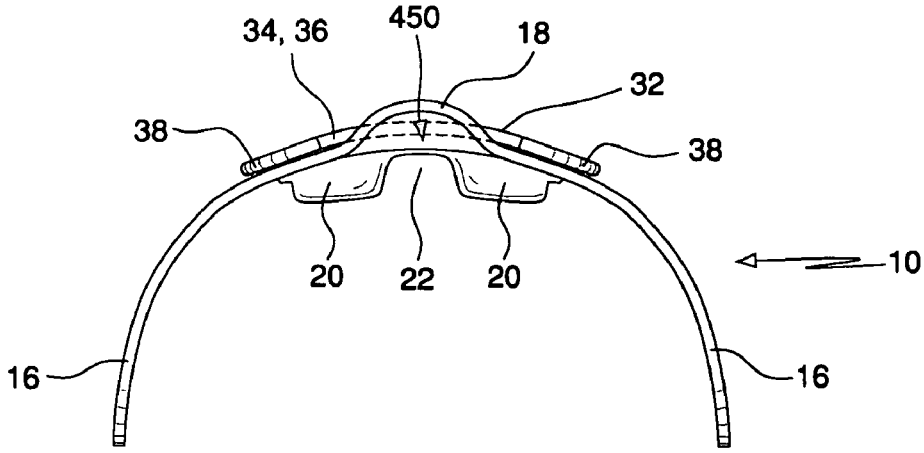
FIG. 12 is a front elevation of the stirrup hangers shown in FIG. 11 attached to the top surface of the saddle of FIG. 2.

FIG. 12 depicts a front elevation view of stirrup hanger 32 in partial phantom affixed to saddle 10 in or around pommel area 18. Optional leg flaps 14 have been removed from this view in order to assist with the visualization from front edge 42 of the orientation of stirrup hanger 32. In an alternative embodiment, and as discussed previously, pommel area 18 may also comprise a substantially flatter profile which conforms more closely to the overall convex shape of the top surface of saddle 10, and which does not provide pommel area opening 450.

The disclosure herein is directed to the variations and modifications of the elements and methods of the invention disclosed that will be apparent to those skilled in the art in light of the disclosure herein. Thus, it is intended that the present invention covers the modifications and variations of this invention, provided those modifications and variations come within the scope of the appended claims and the equivalents thereof.

What claimed is:

1. A treeless exercise saddle for training racehorses, said saddle comprising:

a top surface having a substantially contiguous seat portion adjacent to opposing side panels, and a substantially flat pommel area having no pommel area opening;

a bottom surface opposed to said top surface of said saddle having a pair of opposing conformable panels affixed thereto, wherein said conformable panels each have a substantially rectangular cross section and facing surfaces;

a gullet area, said gullet area formed by said facing surfaces of said conformable panels, together with said bottom surface of said saddle, said gullet area having a cross section wherein said facing surfaces are substantially straight and wherein said bottom surface of said saddle is substantially straight and substantially perpendicular to said straight facing surfaces, and wherein said racehorse's spine may protrude into said gullet area when said saddle is mounted on said racehorse; and leg flaps affixed to said seat portion and said pommel area, wherein the leg flaps terminate substantially near or before the midpoint between the front and rear of said seat portion.

2. The treeless exercise saddle of claim 1, further comprising a stirrup hanger affixed to said top surface of said saddle, wherein said stirrup hanger comprises a pair of quick release stirrup hanger bars affixed to each other by a strap made entirely of leather.

3. The treeless exercise saddle of claim 2 further comprising a girth strap assembly having pair of girth attachment straps made entirely leather and which are connected to each other by a segment made entirely of leather, and wherein said girth strap assembly is affixed to said bottom surface of said saddle.

4. The treeless exercise saddle of claim 3 wherein said stirrup hanger is covered by said leg flaps.

5. The treeless exercise saddle of claim 4, wherein said girth attachment straps adjust to compress said saddle against said racehorse.

6. The treeless exercise saddle of claim 4, wherein said girth attachment straps adjust to substantially compress said pair of opposing conformable panels along said panels bottom surface adjacent said racehorse's spine.

7. The treeless exercise saddle of claim 1, wherein said gullet area has a cross section, wherein said bottom surface of said saddle is substantially straight and wherein said facing surfaces of said conformable panels are substantially straight and substantially angled from said bottom surface of said saddle, and wherein said racehorse's spine may protrude into said gullet area when said saddle is mounted on said racehorse.

8. A treeless exercise saddle for training racehorses, said saddle comprising:

a top surface having a substantially contiguous seat portion adjacent to opposing side panels, and a substantially flat pommel area having no pommel area opening;

a bottom surface opposed to said top surface of said saddle having a pair of opposing conformable panels affixed thereto, wherein said conformable panels each have a substantially rectangular cross section and facing surfaces;

a gullet area space, said gullet area space defined by said facing surfaces of said conformable panels, together with said bottom surface of said saddle, said gullet area space having a cross section wherein said bottom surface of said saddle is substantially straight, and wherein said facing surfaces are substantially straight and substantially perpendicular from said bottom surface of said saddle, wherein said conformable panels contact said racehorse's back adjacent said racehorse's spine and wherein said racehorse's spine protrudes into said gullet area space when said saddle is mounted on said racehorse; and leg flaps affixed to said seat portion and said pommel area, wherein the leg flaps terminate substantially near or before the midpoint between the front and rear of said seat portion.

9. The treeless exercise saddle of claim 8, further comprising a stirrup hanger affixed to said top surface of said saddle, wherein said stirrup hanger comprises a pair of quick release stirrup hanger bars affixed to each other by a strap made entirely of leather.

10. The treeless exercise saddle of claim 9 further comprising a girth strap assembly having pair of girth attachment straps made entirely of leather and which are connected to each other by a segment made entirely of leather, and wherein said girth strap assembly is affixed to said bottom surface of said saddle.

11. The treeless exercise saddle of claim 10 wherein said stirrup hanger is covered by said leg flaps.

12. The treeless exercise saddle of claim 11, wherein said girth attachment straps adjust to compress said conformable panels against said racehorse's back adjacent said racehorse's spine.

13. The treeless exercise saddle of claim 12, wherein said gullet area space has a cross section, wherein said bottom surface of said saddle is substantially straight and wherein said facing surfaces of said conformable panels are substantially straight and substantially angled from said bottom surface of said saddle, and wherein said racehorse's spine may protrude into said gullet area without contacting said bottom surface of said saddle defining gullet area space when said saddle is mounted on said racehorse.

14. The treeless exercise saddle of claim 13, wherein said girth attachment straps adjust to substantially compress said pair of opposing conformable panels along said panels bottom surface adjacent said racehorse's spine.

* * * * *